US008156930B2

(12) United States Patent
Hu

(10) Patent No.: US 8,156,930 B2
(45) Date of Patent: Apr. 17, 2012

(54) CARTRIDGE BOX OF PNEUMATIC TOY GUN

(76) Inventor: Shih-Che Hu, Yung Kang (TW)

( * ) Notice: Subject to any disclaimer, the term of this patent is extended or adjusted under 35 U.S.C. 154(b) by 0 days.

(21) Appl. No.: 12/917,492

(22) Filed: Nov. 2, 2010

(65) Prior Publication Data

US 2012/0048253 A1 Mar. 1, 2012

(51) Int. Cl.
*F41A 9/61* (2006.01)

(52) U.S. Cl. ..... 124/71; 124/51.1; 124/52

(58) Field of Classification Search ..... 42/54; 124/51.1, 124/52, 72–77
See application file for complete search history.

(56) References Cited

U.S. PATENT DOCUMENTS

2011/0283984 A1* 11/2011 Hu ..... 124/77
* cited by examiner

*Primary Examiner* — Michael Carone
*Assistant Examiner* — Daniel Troy
(74) *Attorney, Agent, or Firm* — Raymond Y. Chan; David and Raymond Patent Firm

(57) ABSTRACT

A cartridge box of a pneumatic toy gun includes an air lock system and a struck element disposed on the upper inside the case of the cartridge box, and further includes a control system having a pushing rod and a resisting rod, wherein a front end of the pushing rod extends into the bullet-out passage disposed inside the case. When there is no bullet in the bullet-out passage, a lateral end of the stripping rod resists upward against the front end of the pushing rod to make the back end of the resisting rod moving downward to resist against the resisting portion of the struck element, resulting that the struck element cannot push the air lock system forward. Thereby, when there is no bullet in the cartridge box, even if the trigger is pressed, the air lock system cannot moves to push the bolt. Hence, firing without bullet will be avoided and the effects of the simulate gun would be achieved. The cartridge box further has a turning system having a turning portion with a cam portion, which is turned upward to resist against the resisting rod, resulting that the resisting rod moves away from the resisting portion of the struck element. Thereby the bolt can be pushed to make a fire without bullet.

4 Claims, 8 Drawing Sheets

CARTRIDGE BOX OF PNEUMATIC TOY GUN

BACKGROUND OF THE PRESENT INVENTION

1. Field of Invention

The present invention relates to a cartridge box of a pneumatic toy gun, and more particularly to a pneumatic toy gun, wherein when its trigger is pressed and its cartridge box contains no bullet, the bolt could be controlled by a user to be selectively moved forth and back.

2. Description of Related Arts

The driving principle of the pneumatic toy gun is different from that of the electrical toy gun. Referring to FIG. 1, when the trigger 10 of the pneumatic toy gun is pressed, the hammer 20 drives the firing pin 30 to move forth, which impact the struck element 40 disposed on the upper portion inside the cartridge box. Then the struck element 40 pushes the air lock system 50 forward to open the air inlet 601 of the plunger 60, thereby the inner gas of the cartridge box (a) flows into the plunger 60 to make the bolt 70 to move back as shown in FIG. 2. When the bolt 70 moves back, the hammer 20 is forced to return back. Meanwhile, the firing pin 30 also returns back to force the air lock system 50 to move back, thereby the air inlet 601 of the plunger 60 is closed to stop the flowing of the gas. Due to the spring 701, the bolt 70 moves forth, and then the hammer 20 drives the firing pin 30 to move forth again.

The principles of the gas flowing and the firing structures have been mentioned above. If repeat the movements mentioned above, the gun could be fired continuously.

However, in case the bullets in the cartridge box (a) have been used up and the trigger 10 is still pressed, the hammer 20, the firing pin 30, the struck element 40, the air lock system 50, and the plunger 60 will still keep moving to fire without bullets, instead of stopping. In addition, only when there is no bullet shot out, the user would know there is no bullet in the gun. Hence, when there is no bullet, the continuous movements mentioned above make no sense, and also waste the gas in the cartridge box (a) and reduce the effective firing of the gas, both of which cause damages to the elements. Hence, it is necessary to improve the conventional pneumatic toy gun.

SUMMARY OF THE PRESENT INVENTION

It will be appreciated that the present invention provides a control system, with which the movement of the air lock system could be stopped when there is no bullet, thereby the defects of the conventional pneumatic toy gun, such as when there is no bullet, the gas will still flow to cause the waste of gas and the damages to the elements, could be overcome. Besides, considering some users enjoy firing without bullets, the present invention also provides a system for the users to choose to fire without bullet or not, thereby the selectable functions of the present invention have been improved.

The present invention provides a cartridge box of a pneumatic toy gun, which air lock system could be chosen to be moved forth or not when there is no bullet. The cartridge box comprises a case and a bullet-out passage disposed on an inner side of the case, wherein an elastic element and a stripping rod are disposed inside the bullet-out passage. The elastic element is disposed under the stripping rod, which further has a lateral end. The case further comprises an air lock system and a struck element on the upper inside, wherein the air lock system is disposed in front of the struck element. The struck element is struck by the firing pin of the pneumatic toy gun to push the air lock system moving forward.

The improvement includes that the case further has a slot having a first position and a second position. The struck element has a resisting portion. An upper inside of the case further has a control system which comprises a pushing rod and a resisting rod.

The pushing rod has a front end portion, a middle end portion and a back end portion, wherein the front end portion extends into the bullet-out passage. The resisting rod has a front end and a back end, wherein the front end of the resisting rod is pivotally jointed with the middle end portion of the pushing rod. The back end of the resisting rod has a locking block, which extrudes out of the slot and is located in the first position. If there is no bullet, the lateral end of the stripping rod resists upward against the front end portion of the pushing rod, and then the back end portion of the pushing rod presses downward on the resisting rod to make the back end of the resisting rod move downward to resist against the resisting portion of the struck element. Thereby, the struck element cannot push the air lock system forward to stop the movement of the air lock system when needed, and thus the bolt will not move forth and back. At this time, the locking block is moved downward to the second position.

In addition, the resisting rod further has an upper locating portion and a lower locating portion, both of which are disposed on the back edge of the back end. A locating system is disposed in the case and behind the back end. The locating system has an elastic element disposed on the back to provide a forward elastic force to the locating system. Thereby, when the locking block of the back end of the resisting rod is moved to the first position, the locating system is elastically resisted against the lower locating portion of the resisting rod, and thus when the locking block of the back end of the resisting rod is moved to the second position, the locating system is resisted against the upper locating portion of the resisting rod. As a result, the locating will achieve.

Moreover, the case further has a through hole disposed on the side and a turning system disposed in the through hole. The turning system at least has a hole portion and a turning portion with a cam portion disposed under the resisting rod, wherein the hole portion is turning along with the turning portion. The back end of the resisting rod is moved downward to resist against the resisting portion of the struck element. At this time, the hole portion could be turned to make the turning portion turn along with the hole portion, and then the cam portion of the turning portion will be turned upward to resist against the resisting rod. That causes the back end of the resisting rod to move away from the resisting portion of the struck element, resulting that the air lock system could still be pushed when firing. Thereby, the user could choose to make a fire without bullet. Furthermore, the hole portion has a marking portion, and the through hole has a first indicating portion and a second indicating portion on the outside edge. When it is marked by the marking portion, both of which respectively indicate the situations before and after the cam portion is resisted against the resisting rod. Thereby, the user could know exactly what the structure and the function at that time.

Hence, the present invention provides a control system arranged to accomplish that, when there is no bullet in the pneumatic toy gun, the air lock system cannot be pushed forward and the bolt of the gun cannot move. Thereby, the momentum of the gas will not be wasted and the elements will not run idle to cause damages. Hence, the effects of the simulate gun can be achieved. Furthermore, the turning system is arranged for the users to choose to fire with or without bullets.

These and other objectives, features, and advantages of the present invention will become apparent from the following detailed description, the accompanying drawings, and the appended claims.

DETAILED DESCRIPTION OF THE PREFERRED EMBODIMENT

Figure 1:
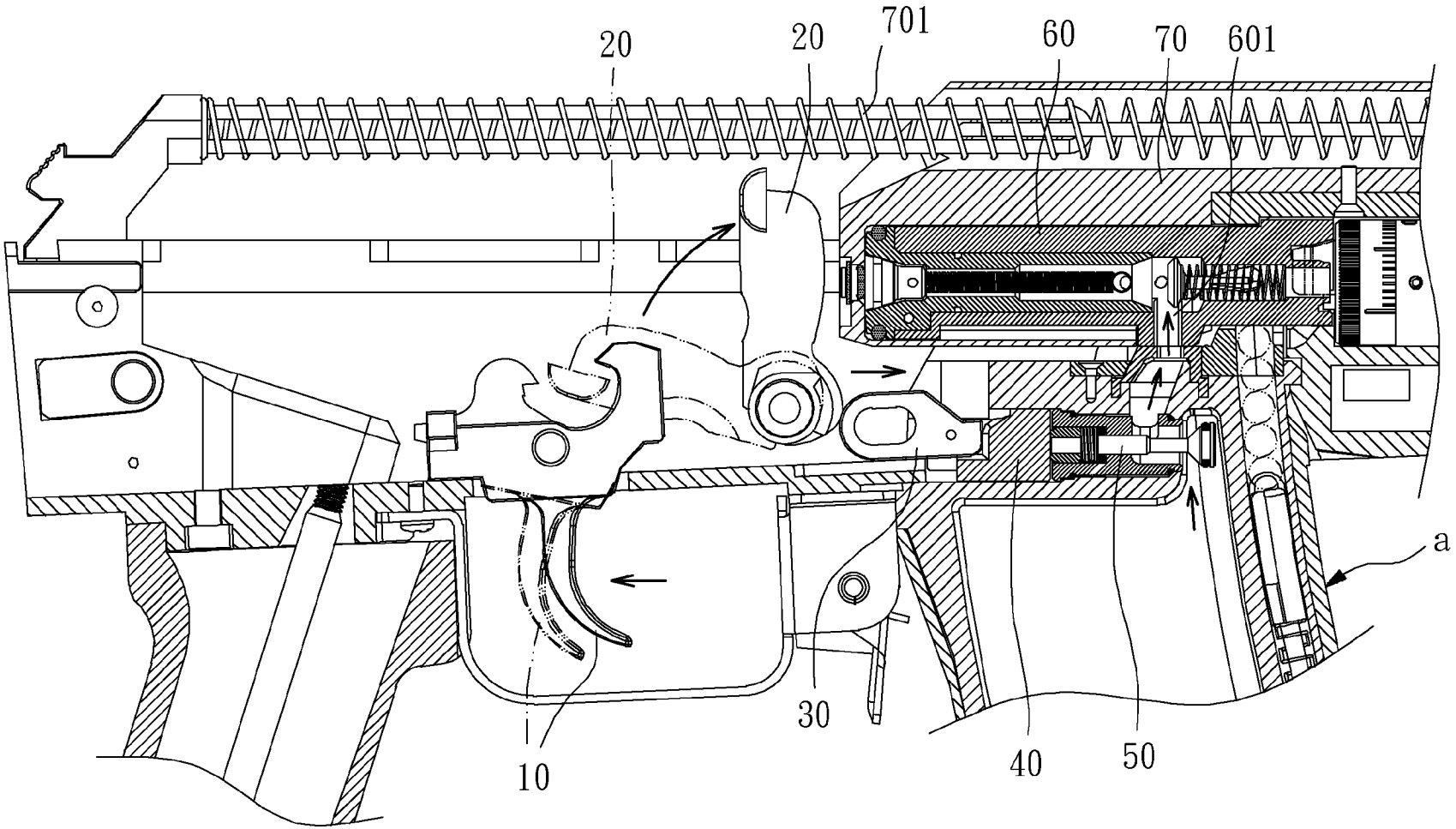
FIG. 1(PRIOR ART)
FIG. 1 is a structural representative view of the driving structures of a pneumatic toy gun.
Figure 2:
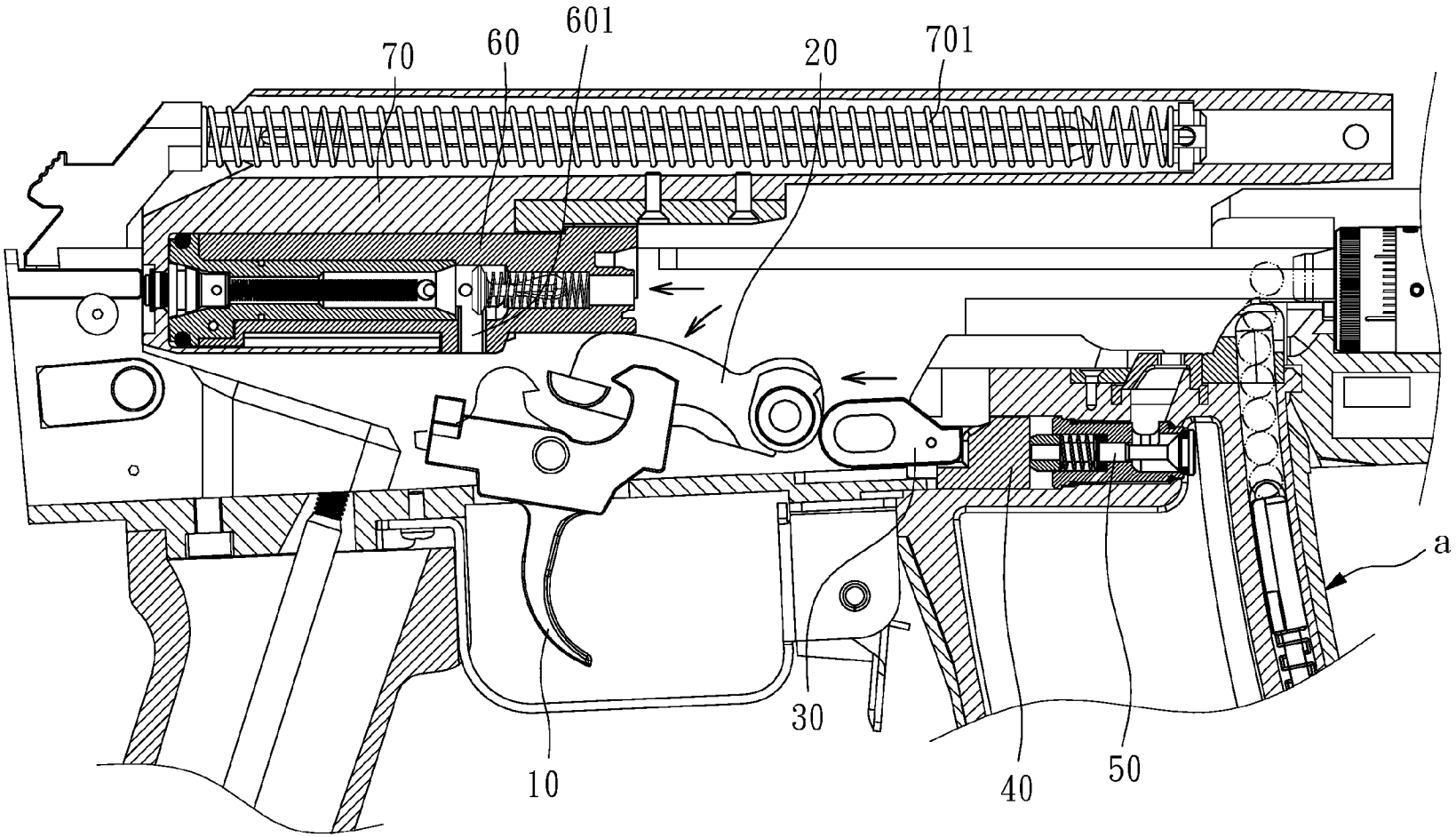
FIG. 2(PRIOR ART)
FIG. 2 is another structural representative view of the driving structures of a pneumatic toy gun.
Figure 3:
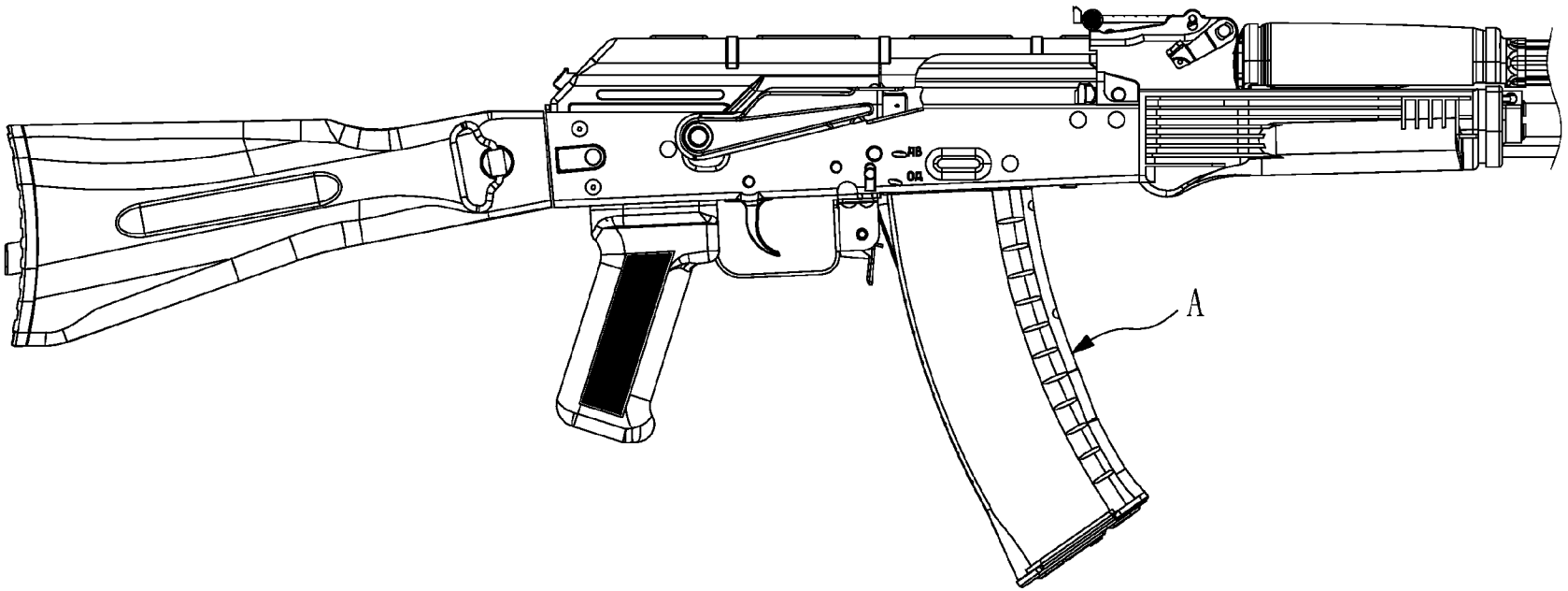
FIG. 3 is a plane diagram of a pneumatic toy gun according to a preferred embodiment of the present invention.

Referring to FIG. 3, a cartridge box A of a pneumatic toy gun according to a preferred embodiment of the present invention is illustrated, which is capable of being used with an AK-type pneumatic toy gun, as well as the pneumatic toy guns showed in FIG. 1 and FIG. 2, wherein the operational principle of which will not be detailed described here. Instead, the cartridge box A will be introduced in detail.

Figure 4:
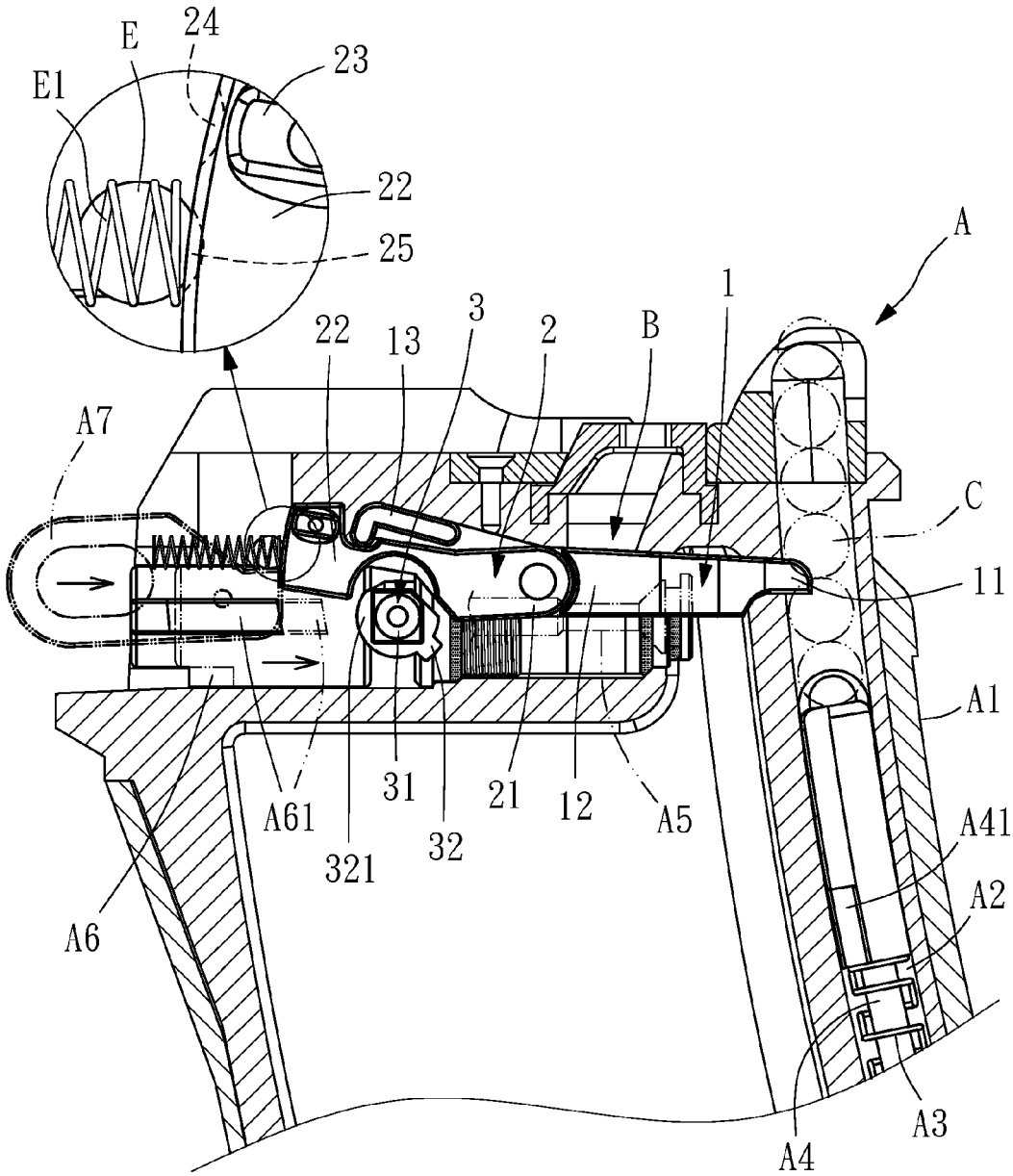
FIG. 4 is a sectional view with partially enlarged of a pneumatic toy gun, illustrating the movement of the bolt, according to the above preferred embodiment of the present invention.

Referring to FIG. 4, the cartridge box A comprises a case A1, a bullet-out passage A2 disposed on an inner side of the case A1, an elastic element A3 and a stripping rod A4, wherein both of the elastic element A3 and the stripping rod A4 are disposed inside the bullet-out passage A2. The elastic element A3 is disposed under the stripping rod A4 to provide an upwards elastic force to the stripping rod A4 which further has a lateral end A41.

Figure 5:
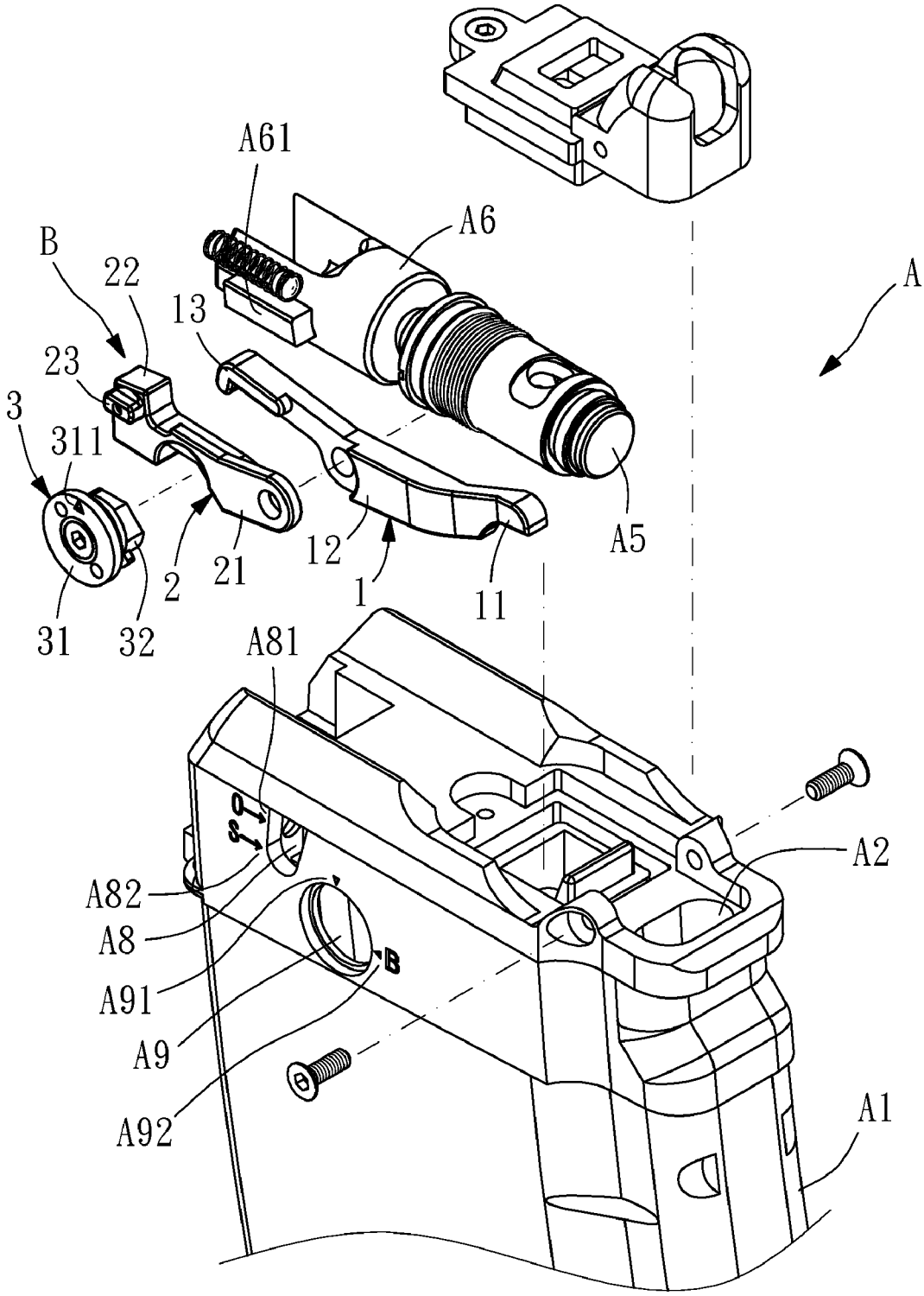
FIG. 5 is an exploded view of the cartridge box according to the above preferred embodiment of the present invention.

Referring to FIG. 5, the case A1 further comprises an air lock system A5 and a struck element A6 on the upper inside, wherein the air lock system A5 is disposed in front of the struck element A6. Referring to FIG. 4, the struck element A6 is struck by the firing pin A7 of the pneumatic toy gun to push the air lock system A5 moving forward.

Referring to FIG. 5, the case A1 further has a slot A8 having a first position A81 and a second position A82. The struck element A6 has a resisting portion A61. The upper inside of the case A1 further has a control system B which comprises a pushing rod 1 and a resisting rod 2.

Figure 6:
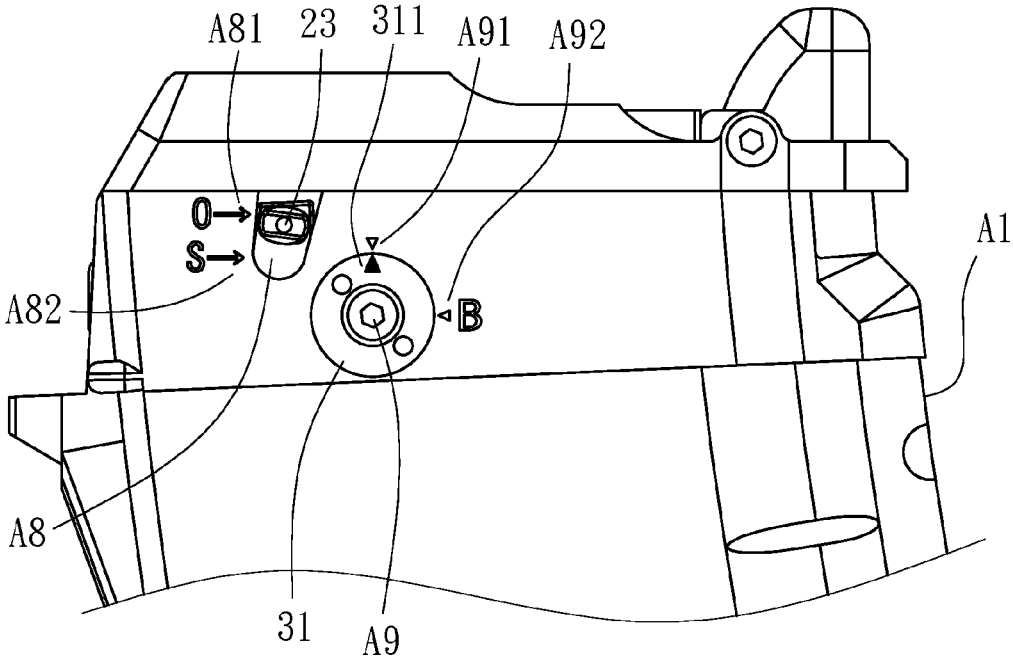
FIG. 6 is a plane diagram illustrating the outer surface according to the above embodiment of the present invention.
Figure 7:
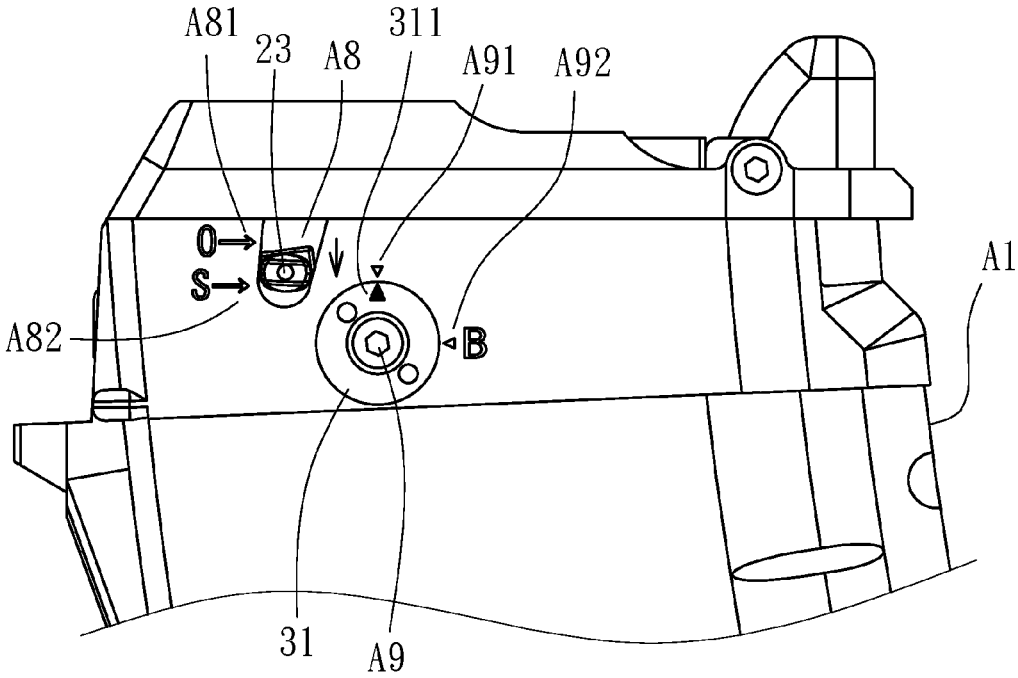
FIG. 7 is a plane diagram illustrating the outer surface according to another preferred embodiment of the present invention.
Figure 8:
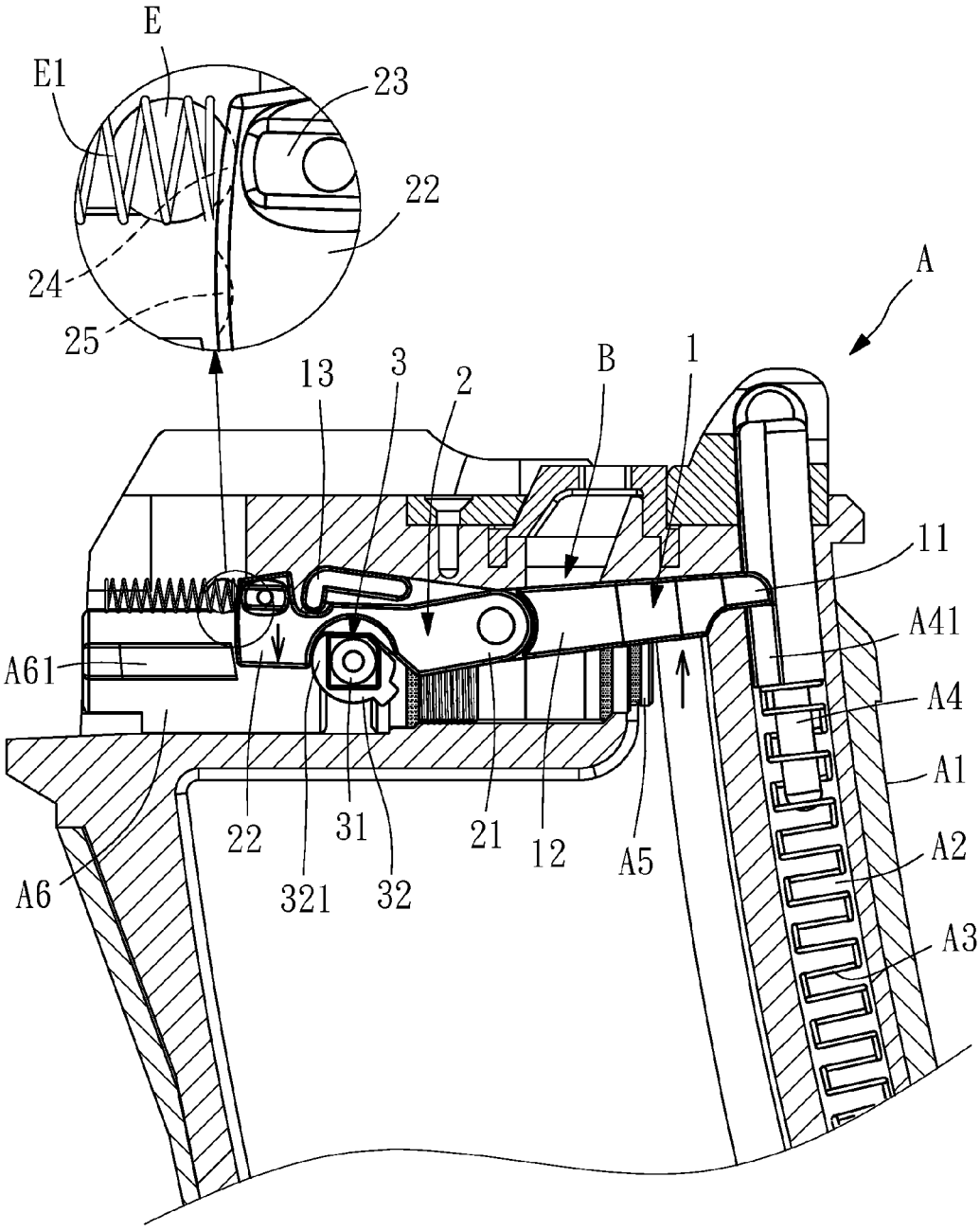
FIG. 8 is a sectional view with partially enlarged of the pneumatic toy gun, illustrating the movement of the bolt without bullet.

Referring to FIG. 4, the pushing rod 1 has a front end portion 11, a middle end portion 12 and a back end portion 13, wherein the front end portion 11 extends into the bullet-out passage A2. The resisting rod 2 has a front end 21 and a back end 22, wherein the front end 21 of the resisting rod 2 is pivotally jointed with the middle end portion 12 of the pushing rod 1 to further pivotally locate on the case A1. Referring to FIG. 6 and FIG. 7, the back end 22 of the resisting rod 2 has a locking block 23, which extrudes out of the slot A8 and moves between the first position A81 and the second position A82. As shown in FIG. 6, if the locking block 23 is moved to the first position A81, it indicates that there are bullets C in the bullet-out passage A2 as shown in FIG. 4. Referring to FIG. 8, if there is no bullet C, the lateral end A41 of the stripping rod A4 resists upward against the front end portion 11 of the pushing rod 1, and then the back end portion 12 of the pushing rod 1 presses downward on the resisting rod 2 to make the back end 22 of the resisting rod 2 moving downward to resist against the resisting portion A61 of the struck element A6. Thereby, even if a fire has been made, the struck element A6 cannot move forward due to being resisted by the back end 22 of the resisting rod 2. That means the struck element A6 cannot push the air lock system A5, thereby the bolt will not move forth and back. At this time, the locking block 23 is moved downward to the second position A82 as shown in FIG. 7.

Referring to FIG. 4 and FIG. 8, the resisting rod 2 further has an upper locating portion 24 and a lower locating portion 25, both of which are disposed on the back edge of the back end 22. A locating system E is disposed in the case A1 and behind the back end 22. The locating system E has an elastic element E1 disposed on the back to provide a forward elastic force to the locating system E. Thereby, when the locking block 23 of the back end 22 is moved to the first position A81 as shown in FIG. 6, the locating system E is elastically resisted against the lower locating portion 25 as shown in FIG. 4, and that when the locking block 23 of the back end 22 is moved to the second position A82 as shown in FIG. 7, the locating system E is resisted against the upper locating portion 24 as shown in FIG. 8. As a result, the back end 22 of the resisting rod 2 will be located after moving back.

Figure 9:
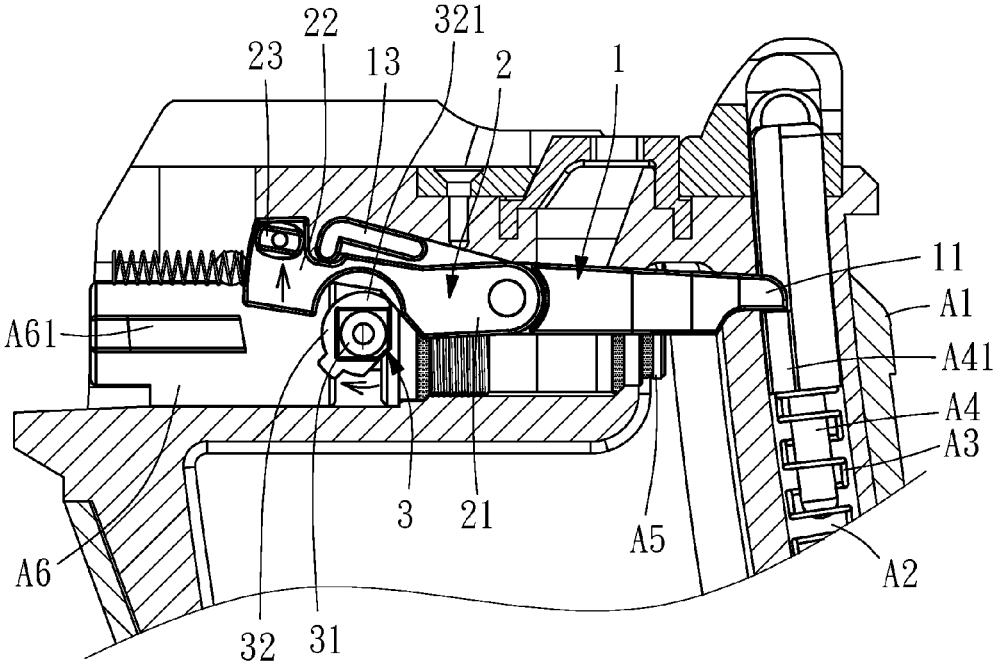
FIG. 9 is a sectional view of the pneumatic toy gun, illustrating the movement of the bolt when a fire without bullet is planned to make.
Figure 10:
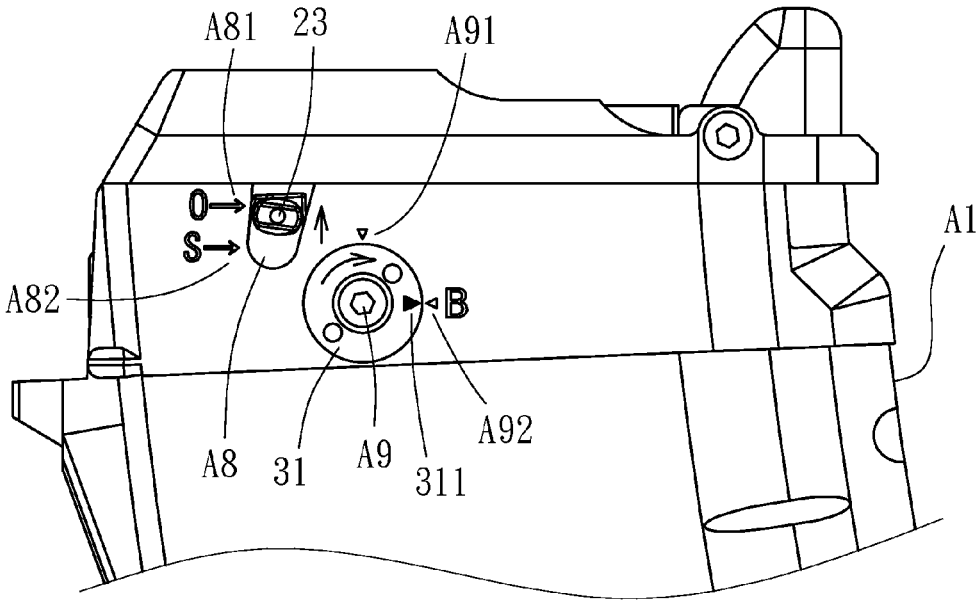
FIG. 10 is a plane diagram illustrating the outer surface according to the above embodiment of the present invention.

Referring to FIG. 5, the case A1 further has a through hole A9 disposed on the side and a turning system 3 disposed in the through hole A9. Referring to FIG. 8, the turning system 3 has a hole portion 31 with a marking portion 311 outside and a turning portion 32 with a cam portion 321 disposed under the resisting rod 2, wherein the hole portion 31 is turning along with the turning portion 32. When there is no bullet C in the bullet-out passage A2, the back end 22 of the resisting rod 2 is moved downward to resist against the resisting portion A61 of the struck element A6. At this time, the hole portion 31 could be turned by tools to make the turning portion 3 turning along with the hole portion 31, and then the cam portion 321 of the turning portion 32 will be turned upward to resist against the resisting rod 2 as shown in FIG. 9. That causes the back end 22 to move away from the resisting portion A61 of the struck element A6, resulting that the air lock system A5 could still be pushed when firing. Thereby, in case that there is no bullet C, the user could still choose to make a fire without bullet. As shown in FIG. 7 and FIG. 10, the through hole A9 has a first indicating portion A91 and a second indicating portion A92 on the outside edge, so that when it is marked by the marking portion 311, both of which respectively indicate the situations before and after the cam portion 321 is resisted against the resisting rod 2, comparing with FIG. 9. Thereby, the user could know exactly what the structure and the function are at that time for well operating.

Based on the structures mentioned above and referred to FIG. 4 without the trigger and the bolt, when there are bullets C in the bullet-out passage A2 and the trigger is pressed, the struck element A6 is impacted by the firing pin A7 to push the air lock system A5 forward, resulting that the bolt of the gun moves forth and back, wherein at this time, the locking block 23 is on the first position A81 as shown in FIG. 6.

Referring to FIG. 8, when there is no bullet C in the bullet-out passage A2, the lateral end A41 of the stripping rod A4 is resisted upward against the front end portion 11 of the pushing rod 1 to further make the back end 22 of the resisting rod 2 moving downward to resist against the resisting portion A61 of the struck element A6. Thereby, the struck element A6 cannot move forward and the air lock system A5 cannot move, resulting that the bolt of the gun cannot moves forth and back, which is not shown in FIG. 8. At this time, the locking block 23 is moved to the second position A82 as shown in FIG. 7. Hence, the forth and back movement of bolt of the gun could be stopped according to the requirement.

Besides, if the bolt of the gun is still needed to move forth and back to make a fire without bullet, the turning system 3 could be turned by tools to make the cam portion 321 of the turning portion 32 resisting upward against the resisting rod 2 as shown in FIG. 9, resulting that the back end 22 is moved away from the resisting portion A61 of the struck element A6 to validate the firing without bullet. At this time, the first indicating portion A91 or the second indicating portion A92 is marked by the marking portion 311 to indicate the situation. Hence, it is very convenient and utility. Furthermore, the turning system 3 could only be turned after the cartridge box A is removed from the pneumatic toy gun.

Based on the structures and embodiments mentioned above, the control system B is arranged to accomplish that, when there is no bullet C in the pneumatic toy gun, the air lock system A5 cannot be pushed forward and the bolt of the gun cannot move. Thereby, the momentum of the gas will not be wasted and the elements will not run idle to cause damages. Hence, the defects of the prior art would be overcome and the effects of the simulate gun could be achieved. Furthermore, the turning system 3 is arranged to make the air lock system A5 and the bolt of the gun workable to allow the gun be fired without bullets, if the user likes.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A cartridge box of a pneumatic toy gun, comprising:

a case with a slot disposed on the side, which has a first position and a second position;

a bullet-out passage, disposed on an inner side of said case, having an elastic element and a stripping rod disposed therein, wherein said stripping rod has a lateral end and is disposed above said elastic element;

an air lock system and struck element disposed on the upper inside of said case, wherein said struck element has a resisting portion and said air lock system is disposed in front of said struck element, which is struck by a firing pin of said pneumatic toy gun to push said air lock system forward;

a control system, which is disposed on the upper inside of said case, comprising a pushing rod and a resisting rod, wherein said pushing rod has a front end portion extending into said bullet-out passage, a middle portion and a back end portion, wherein said resisting rod has a front end pivotally jointed with said middle portion of said pushing rod and a back end with a locking block, which extrudes out of said slot and is located in said first position;

wherein said lateral end of said tripping rod presses upward against said front end portion of said pushing rod, said back end portion of said pushing rod presses downward on said resisting rod to make said back end of said resisting rod moving downward to resist against said resisting portion of said struck element, whereby said struck element cannot push said air lock system forward and said locking block is moved downward to said second position.

2. The cartridge box, as recited in claim 1, wherein said resisting rod further comprises an upper locating portion and a lower locating portion, both of which are disposed on a back edge of said back end of said resisting rod;

wherein said case further has a locating system with an elastic element disposed on the back thereof, wherein said locating system is disposed in said case and behind said back end of said resisting rod;

wherein when said locking block of said back end of said resisting rod is moved to said first portion, said locating system is pressed against said lower locating portion of said resisting rod;

wherein when said locking block of said back end of said resisting rod is moved to said second position, said locating system is pressed against said upper locating portion of said resisting rod.

3. The cartridge box, as recited in claim 1, wherein said case further has a through hole disposed on the side and a turning system disposed in said through hole;

wherein said turning system has a hole portion and a turning portion with a cam portion disposed under said resisting rod, wherein said hole portion turns is along with said turning portion;

wherein when said back end of said resisting rod moves downward to resist forward movement of said resisting portion of said struck element, said hole portion is turned to take said turning portion turning along and said cam portion of which is turned upward to press against said resisting rod, whereby said back end of said resisting rod moves away from said resisting portion of said struck element.

4. The cartridge box, as recited in claim 3, wherein said hole portion comprises a marking portion, herein said through hole has a first indicating portion and a second indicating portion on an outside edge, wherein when said first indicating portion and said second indicating portion are marked by said marking portion, both of which respectively indicate said situations before and after said cam portion is resisted against said resisting rod.

* * * * *